US007605791B2

(12) United States Patent
Okuno

(10) Patent No.: US 7,605,791 B2
(45) Date of Patent: Oct. 20, 2009

(54) LIQUID CRYSTAL DISPLAY HAVING FEED-FORWARD CIRCUIT

(75) Inventor: Takeshi Okuno, Suwon-si (KR)

(73) Assignee: Samsung Mobile Display Co., Ltd., Giheung-Gu, Yongin, Gyunggi-Do (KR)

( * ) Notice: Subject to any disclaimer, the term of this patent is extended or adjusted under 35 U.S.C. 154(b) by 650 days.

(21) Appl. No.: 11/322,275

(22) Filed: Jan. 3, 2006

(65) Prior Publication Data

US 2006/0187167 A1 Aug. 24, 2006

(30) Foreign Application Priority Data

Feb. 22, 2005 (KR) ..... 10-2005-0014699

(51) Int. Cl.
*G09G 3/36* (2006.01)

(52) U.S. Cl. ..... 345/98; 345/204; 345/84; 345/690

(58) Field of Classification Search ..... 345/98
See application file for complete search history.

(56) References Cited

U.S. PATENT DOCUMENTS

| | | | | |
|---|---|---|---|---|
| 6,556,180 | B1 * | 4/2003 | Furuhashi et al. | 345/87 |
| 6,920,331 | B1 * | 7/2005 | Sim et al. | 455/466 |
| 7,136,037 | B2 * | 11/2006 | Ham | 345/89 |
| 7,277,076 | B2 * | 10/2007 | Shiomi et al. | 345/89 |
| 7,289,161 | B2 * | 10/2007 | Yamakawa et al. | 348/607 |
| 7,304,624 | B2 * | 12/2007 | Lee | 345/89 |
| 7,321,351 | B2 * | 1/2008 | Cheon | 345/89 |
| 2002/0024481 | A1 * | 2/2002 | Kawabe et al. | 345/87 |
| 2002/0030652 | A1 * | 3/2002 | Shibata et al. | 345/87 |
| 2002/0033813 | A1 * | 3/2002 | Matsumura et al. | 345/204 |
| 2002/0140652 | A1 * | 10/2002 | Suzuki et al. | 345/87 |
| 2003/0231158 | A1 * | 12/2003 | Someya et al. | 345/101 |
| 2004/0135800 | A1 * | 7/2004 | Shiomi et al. | 345/691 |
| 2004/0145596 | A1 * | 7/2004 | Yamakawa et al. | 345/690 |

FOREIGN PATENT DOCUMENTS

| | | |
|---|---|---|
| JP | 07-121138 | 5/1995 |
| JP | 2002-341841 | 11/2002 |
| KR | 10-2000-0060815 | * 10/2000 |

OTHER PUBLICATIONS

Office action from the Japanese Patent Office Issued in Applicant's corresponding Japanese Patent Application No. 2005-245016 dated Mar. 24, 2009.

* cited by examiner

*Primary Examiner*—Richard Hjerpe
*Assistant Examiner*—Gregory J Tryder
(74) *Attorney, Agent, or Firm*—Robert E. Bushnell, Esq.

(57) ABSTRACT

A liquid crystal display (LCD) has a feed-forward circuit, as a result of which an interference phenomenon occurring in each line of an LCD panel (that is, a color blurring) is prevented, and image quality and life of the LCD panel are enhanced. The LCD comprises a feed-forward circuit for comparing first digital data and second digital data, for generating a correction value based on the comparison, for applying the correction value to the second digital data to obtain corrected digital data, and for outputting the corrected digital data, and a liquid crystal display panel for receiving the corrected digital data, and for displaying an image corresponding to the corrected digital data.

18 Claims, 3 Drawing Sheets

LIQUID CRYSTAL DISPLAY HAVING FEED-FORWARD CIRCUIT

CLAIM OF PRIORITY

This application makes reference to, incorporates the same herein, and claims all benefits accruing under 35 U.S.C. § 119 from an application for LIQUID CRYSTAL DISPLAY HAVING FEED-FORWARD CIRCUIT earlier filed in the Korean Intellectual Property Office on the 22 of Feb. 2005 and there duly assigned Serial No. 2005-14699.

BACKGROUND OF THE INVENTION

1. Technical Field

The present invention relates to a liquid crystal display (LCD) and, more particularly, to an LCD having a feed-forward circuit capable of preventing colors from blurring on an LCD panel.

2. Related Art

In recent years, personal computers, televisions or the like have become lightweight and small-sized, which has been therefore accompanied by requirements for lightweight and small-sized displays, so that flat panel displays such as the LCD, as opposed to the cathode ray tube (CRT), are under development.

The LCD is a display in which an electric field is applied to liquid crystal having an anisotropic dielectric constant and injected between two substrates, and the intensity of the electric field is adjusted so as to adjust the amount of light transmitted onto the substrate from an external light source (backlight), thereby obtaining a desired image signal.

The LCD is representative among portable flat panel displays, and a thin film transistor liquid crystal display (TFT-LCD), which uses TFTs as switching elements, is mainly employed.

In general, the LCD includes: an LCD panel having an upper substrate, a lower substrate, and a liquid crystal disposed between the upper and lower substrates; a driving circuit for driving the LCD panel; and a backlight for emitting light toward the LCD panel. The LCD is classified as either a color filter LCD or a color field sequential LCD according to the manner in which a color image is displayed.

In the color filter LCD, one pixel is divided into R, G and B sub-pixels. R, G and B color filters are arranged on the R, G and B sub-pixels, respectively. Thus, light is emitted from one backlight to the R, G and B color filters through the liquid crystal, thereby displaying a color image.

In the color field sequential LCD, a separate light source for each of the R, G and B colors is sequentially and periodically turned on, and a color signal corresponding to each pixel is applied in synchronization with the turning-on period to thereby obtain an image with full color. That is, in the color field sequential LCD, R, G and B backlights are arranged on one pixel that is not divided into R, G and B sub-pixels, unlike in the color filter LCD. Lights of three primary colors of red, green and blue are respectively emitted from the R, G and B backlights toward one pixel through the liquid crystal in a time-division manner, thereby utilizing persistence of vision to display the color image.

Accordingly, the color field sequential LCD requires only one-third of the number of pixels while maintaining the same resolution as that of the color filter LCD, so that it has advantages in that high integration can be implemented, and color reproduction equal to that of a color TV and a fast moving picture can be realized.

Unlike the color filter LCD in which a scanning operation is sequentially performed from an upper end to a lower end of a screen, the color field sequential LCD has different driving times of R, G and B backlights in each pixel to synthesize light of three primary colors of red, green and blue so that a color is displayed, and this is why one frame is divided into three subframes and is driven.

That is, one frame is divided into an R subframe displaying an R color, a G subframe displaying a G color, and a B subframe displaying a B color, so that the R backlight is driven in the R subframe to display the R color, the G backlight is driven in the G subframe to display the G color, and the B backlight is driven in the B subframe to display the B color, thereby displaying R, G and B colors per subframe emitting lights different from each other to represent a color image.

The color field sequential LCD has advantages in that a resolution about three times that in the same panel can be implemented and light efficiency can be enhanced because it does not use a color filter, in contrast to the color filter LCD. On the contrary, it has one frame divided into three subframes and driven so that it requires a driving frequency at least six times higher than that of the color filter LCD and a fast operating characteristic is required.

Liquid crystal deteriorates due to its own property when a voltage having the same polarity is continuously applied thereto, so that a voltage having the opposite polarity should be applied thereto. Accordingly, when a positive voltage is applied to any one pixel, a negative voltage should be applied to the pixel in the next frame so as to drive the pixel.

Prior LCDs have certain shortcomings. For example, an interference phenomenon between adjacent lines, that is, a color blurring, often occurs when predetermined R, G and B digital data are received in each line of the LCD panel, so that image quality and life of the LCD panel are degraded.

SUMMARY OF THE INVENTION

The present invention provides a liquid crystal display (LCD) having a feed-forward circuit for compensating and correcting predetermined R, G and B digital data received by each line of the LCD.

Additional features of the invention will be set forth in the description which follows, and in part will be apparent from the description, or may be learned by practice of the invention.

The present invention relates to an LCD comprising: a feed-forward circuit for comparing first digital data and second digital data, for generating a correction value based on the comparison, for applying the correction value to the second digital data, and for outputting corrected digital data; and a liquid crystal display panel for receiving the corrected digital data, and for displaying an image corresponding to the corrected digital data.

The present invention also relates to an LCD comprising: an ON-counter for receiving first digital data and second digital data, and for counting the number of bits represented as one among the first digital data, and the number of bits represented as one among the second digital data; a memory for storing the number of bits represented as one among the first digital data and the number of bits represented as one among the second digital data; an operator for receiving the number of bits represented as one among the first digital data and the number of bits represented as one among the second digital data, and for generating compensation data by means of operation; a level regulator for receiving the compensation data, for processing the compensation data with a correction coefficient, and for generating a correction value; a mixer for operating on the second digital data and the correction value, and for generating corrected digital data; and a liquid crystal display panel for receiving the corrected digital data, and for displaying an image corresponding to the corrected digital data.

The present invention also relates to an LCD comprising: an OFF-counter for receiving first digital data and second digital data, and for counting the number of bits represented as zero among the first digital data and the number of bits represented as zero among the second digital data; a memory for storing the number of bits represented as zero among the first digital data and the number of bits represented as zero among the second digital data; an operator for operating on the number of bits represented as zero among the first digital data and the number of bits represented as zero among the second digital data, and for generating compensation data; a level regulator for receiving the compensation data, for processing the compensation data with a correction coefficient, and for generating a correction value; a mixer for operating on the second digital data and the correction value, and for generating corrected digital data; and a liquid crystal display panel for receiving the corrected digital data, and for displaying an image corresponding to the corrected digital data.

It is to be understood that both the foregoing general description and the following detailed description are exemplary and explanatory, and are intended to provide further explanation of the invention as claimed.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

The present invention will now be described more fully hereinafter with reference to the accompanying drawings.

Figure 1:
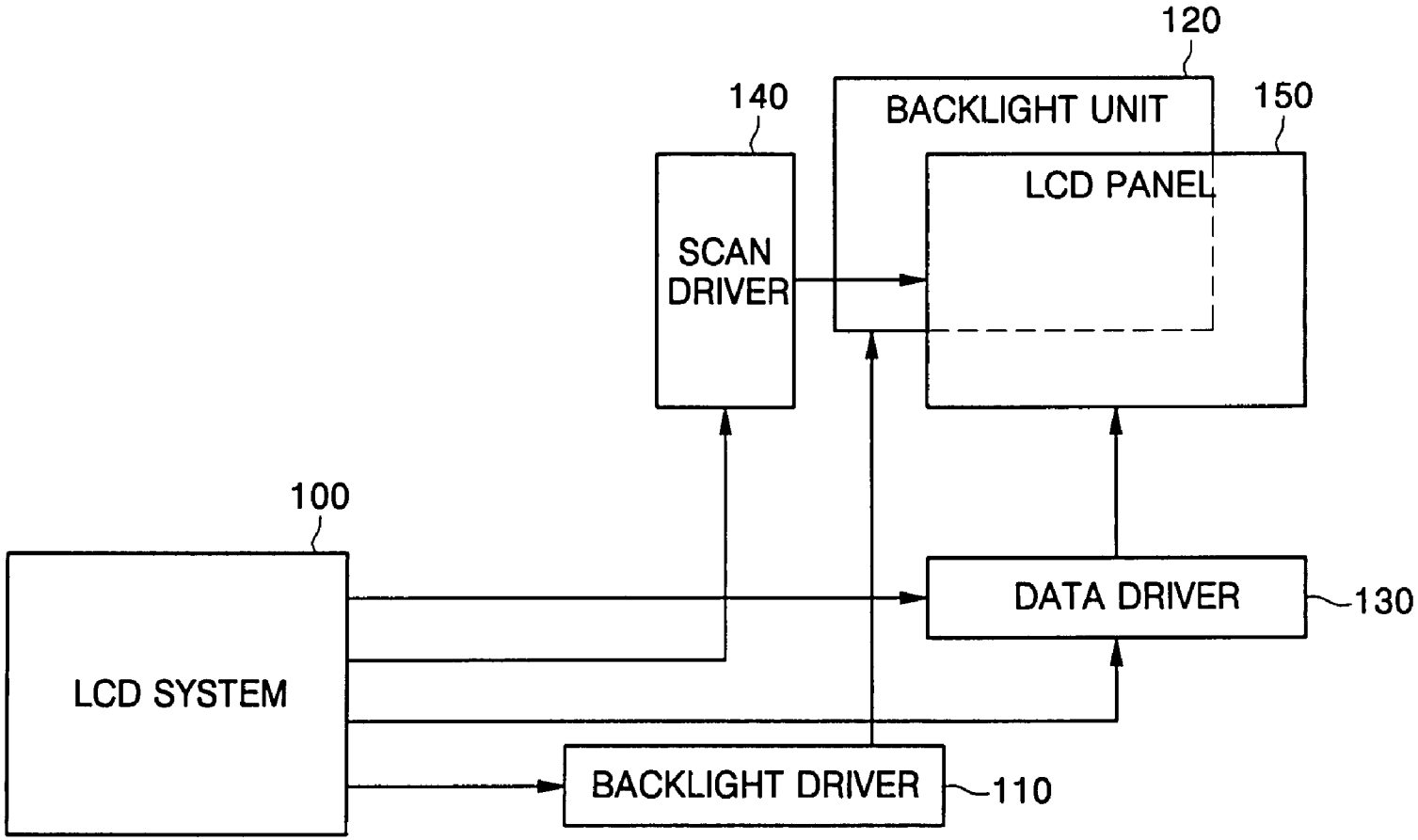
FIG. 1 is a schematic block diagram of a liquid crystal display.

FIG. 1 is a schematic block diagram of an LCD.

Referring to FIG. 1, the LCD includes an LCD system 100, a backlight driver 110, a backlight unit 120, a data driver 130, a scan driver 140, and an LCD panel 150.

The LCD system 100 includes a power supply, a controller, a data converter, a memory, and a buffer (not shown in FIG. 1).

In detail, the power supply supplies a predetermined voltage to the corresponding circuits of the LCD system 100 so that the circuits are driven.

The controller carries out signal processing and control by generating control signals, such as a write command signal, a read command signal, and a timing control signal, for controlling the corresponding circuits of the LCD system 100.

In addition, the data converter is a circuit which operates under the control of the controller, and image data inputted to the data converter are converted to digital data, such as R, G and B data, and are then delivered to the memory.

In addition, the memory stores the R, G and B data in response to the write command signal from the controller. The R, G and B data stored in the memory are delivered to the buffer in response to the read command signal from the controller.

In addition, the buffer inputs the R, G and B data delivered from the memory to the data driver in a serial data format. However, the buffer is not necessarily required, so that the R, G and B data may be directly transferred from the memory to the data driver 130.

The backlight driver 110 includes a driving voltage generator and a pulse width modulation (PWM) signal generator (not shown in FIG. 1). The driving voltage generator inputs a driving condition related to brightness of the backlight among The driving conditions provided by the LCD system 100 to generate forward driving voltages RVf, GVf and BVf suitable for the backlight unit 120. That is, the backlight driver 110 receives a predetermined control signal from the LCD system 100, generates the forward driving voltage, and then delivers it to the backlight unit 1120 so that the backlight unit 120 is driven. The PWM signal generator inputs a driving condition related to chromaticity of the backlight unit 120 among the driving conditions provided by the LCD system 100 so as to sequentially generate PWM signals RPWM, GPWM and BPWM suitable for the R, G and B light emitting diodes (LED), respectively, of the backlight unit 120.

The backlight unit 120 comprises R, G and B LEDs, a mold frame, a reflective sheet, a light guide plate, a diffusion sheet, a prism sheet and a protective sheet (not shown in FIG. 1). The R, G and B LEDs are elements which emit light for the first time, and small-sized R, G and B LEDs are semi-permanently employed in the case of information communication equipment and a handheld terminal. The R, G and B LEDs are driven by the forward driving voltages RVf, GVf, and BVf, respectively, and the PWM signals RPWM, GPWM and BPWM, respectively, which are provided by the backlight driver 110, thereby emitting R, G and B lights, respectively, having predetermined brightness and chromaticity.

The mold frame acts to maintain the R, G and B LEDs, the reflective sheet, the light guide plate, the diffusion sheet, the prism sheet, and the protective sheet included in the backlight unit 120 as one assembled component.

The reflective sheet reflects, toward a top surface, light coming out of a bottom of the light guide plate due to total reflection of the light guide plate among the lights emitted from the LEDs so that brightness can be enhanced as a whole, and light loss from the rear surface of the light guide plate can be prevented.

The light guide plate acts to uniformly distribute light emitted from the LEDs in a two-dimensional plane, and to change the direction of light toward the top surface. To this end, constant patterns are printed on the surface so as to enhance light efficiency.

In this case, the light guide plate is formed of a transparent acrylic resin, and has less deformation and fragility because of its high strength. Also, the light guide plate is lightweight and has high visible ray transmittance.

The diffusion sheet acts to make light, irradiated from the light guide plate, more uniform and smoother as a whole, and to make the light guide plate pattern not shown.

The prism sheet refracts and focuses the light so as to prevent brightness from degrading due to the diffusion sheet so that the brightness can be enhanced. The prism sheet has a fine pitch which is shaped like a pyramid, a mountain range, and so on, which has a lower side which is vertically shaped and an upper side which is horizontally shaped. In general, a set of vertical and horizontal sheets is used for the prism sheet.

That is, the prism sheet receiving light from various angles changes the prism-shaped pitch and the angle in a constant direction so that front brightness can be enhanced.

The protective sheet is a layer for preventing an external impact from being applied to the backlight unit 120 and for preventing contamination caused by a foreign substance, and is positioned on the prism sheet. In addition, the protective sheet is used to prevent a scar from occurring on the prism sheet, and to prevent a Moire phenomenon from occurring when a set of vertical and horizontal prism sheets is used. In addition, it acts to increase viewing angle which is narrowed by the prism sheet. However, the function of the prism sheet has been significantly enhanced in recent years so that the trend is toward not using the protective sheet.

The data driver 130 sequentially receives predetermined R, G and B color data in serial data formats from the LCD system 100, and delivers them to a plurality of data lines of the LCD panel 150.

The scan driver 140 receives a predetermined timing control signal from the LCD system 100, and delivers it to a plurality of scan lines of the LCD panel 150.

The LCD panel 150 is an element used for displaying various information. However, it is a passive display element which does not emit light by itself so that a separate device, such as a light source for lighting the screen of the LCD, is required to be positioned on its rear surface. That is, the LCD panel 150 emits light when it receives light delivered by the backlight unit 120. In addition, the LCD panel 150 has a plurality of pixels arranged in rows and columns, and a plurality of scan lines for selecting the plurality of pixels. In addition, the LCD panel 150 has a plurality of data lines for delivering a reset voltage and a gray scale data voltage corresponding to gray scale data, the data lines being crossed with and insulated from a plurality of scan lines. Subsequently, the plurality of pixels arranged in a matrix form are surrounded by the respective scan lines and the data lines. Each of the pixels includes a thin film transistor (TFT) in which a gate electrode and a source electrode are connected to the scan line and the data line, a pixel capacitor connected to a drain electrode of the TFT, and a storage capacitor.

Figure 2:
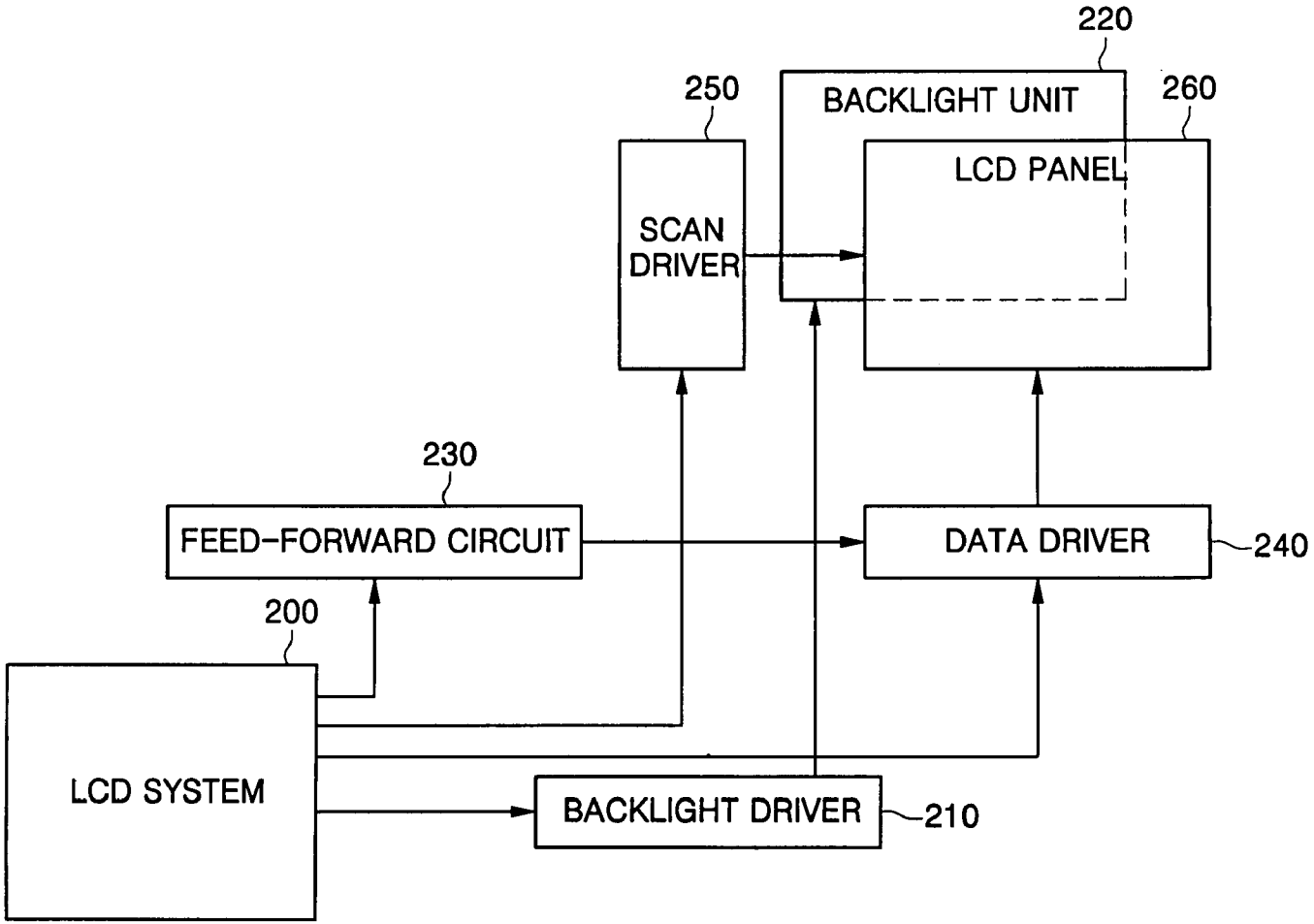
FIG. 2 is a schematic block diagram of a liquid crystal display having a feed-forward circuit in accordance with the present invention.

FIG. 2 is a schematic block diagram of an LCD having a feed-forward circuit in accordance with the present invention.

Referring to FIG. 2, the LCD includes an LCD system 200, a backlight driver 210, a backlight unit 220, a feed-forward circuit 230, a data driver 240, a scan driver 250, and an LCD panel 260.

The LCD system 200 generates a predetermined control signal so as to cause the LCD panel 260 to display, and delivers the control signal to operate the backlight driver 210, the backlight unit 220, the feed-forward circuit 230, the data driver 240, and the scan driver 250.

The backlight driver 210 has a driving voltage generator and a PWM signal generator (not shown in FIG. 2). The driving voltage generator inputs a driving condition associated with brightness of the backlight, and generates forward driving voltages RVf, GVf and BVf suitable for the backlight unit 220. That is, the backlight driver 210 receives a predetermined drive control signal, generates a forward driving voltage, and supplies it to the backlight unit 220 so as to drive the backlight unit 220. The PWM signal generator receives a driving condition associated with chromaticity of the backlight unit 220, and sequentially generates PWM signals RPWM, GPWM and BPWM suitable for the R, G and B LEDs, respectively, of the backlight unit 220.

The backlight unit 220 comprises R, G and B LEDs which sequentially emit light of three primary colors of red, green and blue, respectively, a mold frame, a reflective sheet, a light guide plate, a diffusion sheet, a prism sheet, and a protective sheet.

The R, G and B LEDs comprises an R LED emitting R light, a G LED emitting G light, and a B LED emitting B light, and sequentially emit the lights provided to the LCD panel 260. The R, G and B LEDs are driven by the forward driving voltages RVf, GVf and BVf, respectively, and the PWM signals RPWM, GPWM and BPWM, respectively, which are provided by the backlight driver 210, and selectively emit R, G and B lights, respectively, having predetermined brightness and chromaticity in response to respective predetermined enable signals.

The mold frame acts to maintain the R, G and B LEDs, the reflective sheet, the light guide plate, the diffusion sheet, the prism sheet, and the protective sheet included in the backlight unit 220 as one assembled component.

The reflective sheet reflects, toward a top surface, light coming out of a bottom of the light guide plate due to total reflection of the light guide among light emitted by the LEDs so that brightness can be enhanced as a whole, and light loss from the rear surface of the light guide plate can be prevented.

The light guide plate acts to uniformly distribute light emitted by the LEDs in a two-dimensional plane, and to change the directions toward the top surface. To this end, constant patterns are printed on the surface to enhance light efficiency.

In this case, the light guide plate is formed of a transparent acrylic resin, and has less deformation and fragility because of its high strength. Also, the light guide plate is lightweight and has high visible ray transmittance.

The diffusion sheet acts to make light irradiated from the light guide plate more uniform and smoother as a whole, and to make the light guide plate pattern not shown.

The prism sheet refracts and focuses light so as to prevent brightness from degrading due to the diffusion sheet and so that the brightness can be enhanced. The prism sheet has a fine pitch shaped like a pyramid, a mountain range, and so on, and its lower side is vertically shaped and its upper side is horizontally shaped. In general, a set of vertical and horizontal sheets is used for the prism sheet. That is, the prism sheet receiving light from various angles changes the prism-shaped pitch and the angle in a constant direction so that front brightness can be enhanced.

The protective sheet is a layer for preventing an external impact from being applied to the backlight unit 220 and for preventing contamination caused by a foreign substance, and is positioned on the prism sheet. In addition, the protective sheet is used to prevent a scar from occurring on the prism sheet, and to prevent a Moire phenomenon from occurring when a set of vertical and horizontal prism sheets is used. In addition, it acts to increase viewing angle which is narrowed by the prism sheet. However, the function of the prism sheet has been significantly enhanced in recent years so that the trend has been toward not using the protective sheet.

In addition, with respect to the feed-forward circuit 230, when it delivers received R, G and B digital data to respective lines of the LCD panel 260, the R, G and B digital data are compared with R, G and B digital data inputted in the closest order and then corrected. Accordingly, the R, G and B digital data corrected by the feed-forward circuit 230 are outputted to the respective lines of the LCD panel 260 through the data driver 240.

The data driver 240 sequentially receives predetermined R, G and B color data as serial data in response to predetermined enable signals, and delivers them to a plurality of data lines of the LCD panel 260.

The scan driver 250 selectively receives a predetermined timing control signal, and delivers it to a plurality of scan lines of the LCD panel 260 so as to control a plurality of pixels.

The LCD panel 260 is an element used for displaying various information. However, it is a passive display element which does not emit light by itself so that a separate device, such as a light source for lighting the screen of the LCD, is required to be positioned on its rear surface. That is, the LCD panel 260 emits light when it receives light delivered by the backlight unit 220. In addition, the LCD panel 260 has a plurality of pixels arranged in rows and columns, and a plurality of scan lines for selecting the plurality of pixels. In addition, the LCD panel 150 has a plurality of data lines for delivering a reset voltage and a gray scale data voltage corresponding to gray scale data, the data lines being crossed with, and insulated from, the plurality of scan lines. Subsequently, the plurality of pixels arranged in matrix form are surrounded by the respective scan lines and the data lines. Each of the pixels includes a thin film transistor (TFT) in which a gate electrode and a source electrode are connected to the scan line and the data line, a pixel capacitor connected to a drain electrode of the TFT, and a storage capacitor.

In this case, the liquid crystal used for the LCD panel 260 has the properties of both crystal and liquid, and may include thermotropic LC and lyotropic LC types.

Figure 3:
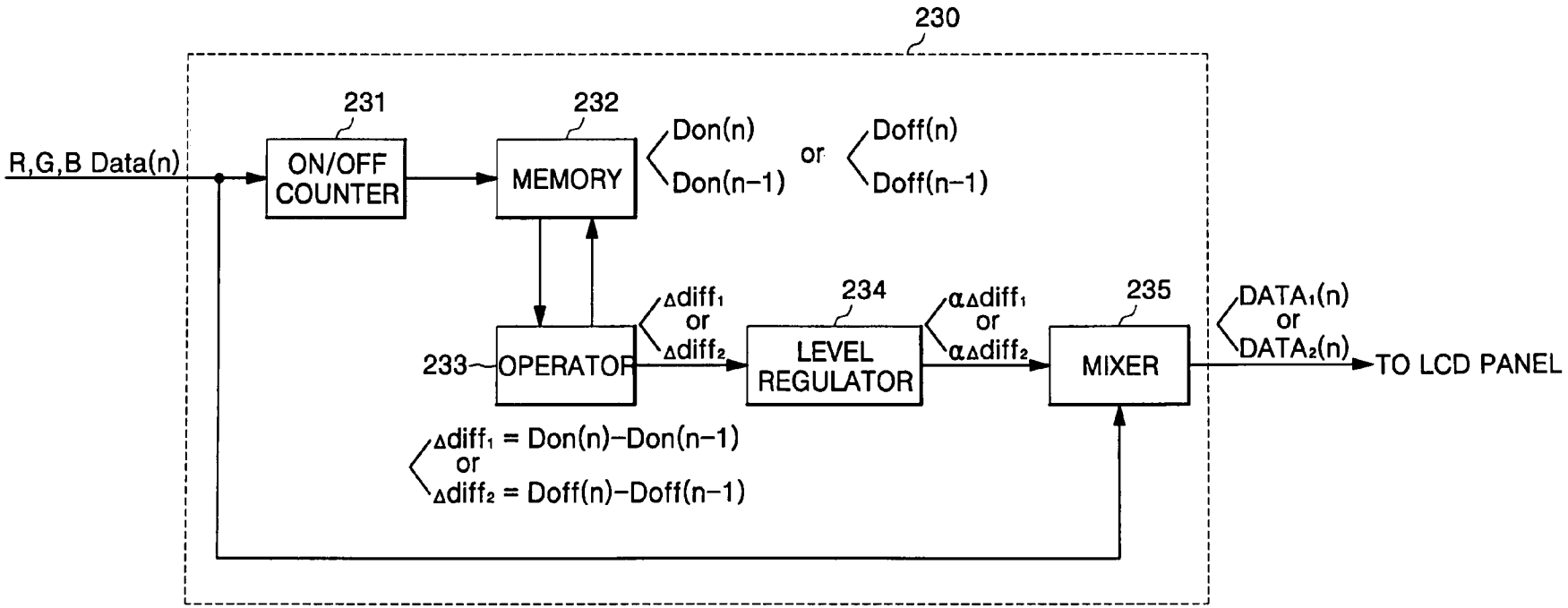
FIG. 3 is a detailed block diagram of a feed-forward circuit included in a liquid crystal display in accordance with the present invention.

FIG. 3 is a detailed block diagram of a feed-forward circuit included in a liquid crystal display in accordance with the present invention.

Referring to FIG. 3, the feed-forward circuit 230 included in the LCD has an ON/OFF counter 231, a memory 232, an operator 233, a level regulator 234, and a mixer 235.

When the feed-forward circuit 230 delivers received R, G and B digital data to respective lines of the LCD panel 260 of FIG. 2, the R, G and B digital data are compared with R, G and B digital data input in the closest order, and then corrected. Accordingly, the R, G and B digital data corrected by the feed-forward circuit 230 are outputted to the respective lines of the LCD panel of 260 of FIG. 2.

In addition, the feed-forward circuit 230 has a first feed-forward path and a second feed-forward path. The first feed-forward path is through the ON/OFF counter 231, the memory 232, the operator 233, and the level regulator 234, and the second feed-forward path is a path in which R, G and B digital data inputted to the LCD in the $n^{th}$ order are reflected into the mixer 235.

The first feed-forward path is a path for comparing the number of bits represented as one among R, G and B digital data inputted to the LCD panel 260 in the $(n-1)^{th}$ order and the number of bits represented as one among R, G and B digital data inputted to the LCD panel 260 in the $n^{th}$ order, and for generating corrected data with respect to the R, G and B digital data of the LCD panel 260.

The second feed-forward path is a path for transferring the R, G and B digital data inputted to the LCD in the $n^{th}$ order.

Accordingly, the feed-forward circuit 230 is a circuit for operating on the corrected data as the output values of the first feed-forward path and the R, G and B digital data inputted to the LCD in the $n^{th}$ order as the output values of the second feed-forward path using the mixer 235, and for outputting the corrected R, G and B digital data.

More specifically, the ON/OFF counter 231 of the feed-forward circuit 230 receives predetermined R, G and B digital data. The ON/OFF counter 231 receives the R, G and B digital data, and determines the bit states of the R, G and B digital data (R, G and B Data(n−1)) to be inputted to the LCD panel 260 in the $(n-1)^{th}$ order. That is, it makes a determination of ON when R, G and B Data (n−1) are one, and it makes determination of OFF when R, G and B Data(n−1) are zero. Accordingly, the ON/OFF counter 231 operates on the number of bits of R, G and B Data(n−1) which are turned ON or OFF, and then sends the number of ON/OFF bits of the R, G and B Data (n−1) to the memory 232.

In addition, when the R, G and B digital data (R, G and B Data (n−1)) inputted to the LCD panel 260 in the $(n-1)^{th}$ order are delivered to the memory 232, the ON/OFF counter 231 determines the bit states of the R, G and B digital data (R, G and B Data(n)) to be inputted to the LCD panel 260 in the $n^{th}$ order. That is, the ON/OFF counter 231 operates on the number of bits of R, G and B Data(n) which are turned ON or OFF, and then sends the number of bits of R, G and B Data(n) for storage in the memory 232.

Accordingly, the ON/OFF counter 231 sends to the memory 232 the number of ON/OFF bits of the R, G and B digital data (R, G and B Data(n−1)) inputted to the LCD panel 260 in the $(n-1)^{th}$ order and the number of ON/OFF bits of the R, G and B digital data (R, G and B Data(n)) inputted to the LCD panel 260 in the $n^{th}$ order.

In this case, the number of ON/OFF bits of the R, G and B Data (n−1) and the number of ON/OFF bits of the R, G and B Data (n) add up to about one hundred, each representing zero or one.

The memory 232 sequentially receives the number of ON/OFF bits of the R, G and B Data(n−1) and the number of ON/OFF bits of the R, G and B Data(n) from the ON/OFF counter 231, and stores them in addresses.

In addition, the memory 232 delivers the number of ON/OFF bits of the R, G and B Data(n−1) and the number of ON/OFF bits of the R, G and B Data(n), which are stored in the addresses, to the operator 233.

The operator 233 receives the number of ON/OFF bits of the R, G and B Data(n−1) and the number of ON/OFF bits of the R, G and B Data(n) from the memory 232, and sends a predetermined command signal to bring data stored in the addresses of the memory 232. In addition, the operator 233 compares the number of ON/OFF bits of the R, G and B Data(n−1) with the number of ON/OFF bits of the R, G and B Data(n), and operates on the number of ON/OFF bits of the R, G and B Data(n−1) and the number of ON/OFF bits of the R, G and B Data(n).

In this case, the ON/OFF bits of the R, G and B Data(n−1) have values of one or zero, and the ON/OFF bits of the R, G and B Data(n) also have values of bits of one or zero.

The compensation data Δdiff are obtained by subtracting the number of ON/OFF bits of the R, G and B Data(n−1) from the number of ON/OFF bits of the R, G and B Data(n), and the compensation data Δdiff can be divided into first compensation data $\Delta diff_1$ and second compensation data $\Delta diff_2$.

The first compensation data $\Delta diff_1$ are obtained by subtracting the number of bits Don(n−1) presenting the count of one based on the R, G and B digital data (R, G, and B Data(n−1)), inputted to the $(n-1)^{th}$ line of the LCD panel 260, from the number of bits Don(n) presenting the count of one based on the R, G and B digital data (R, G, and B Data(n)) inputted to the $n^{th}$ line of the LCD panel 260.

In addition, the second compensation data $\Delta diff_2$ are obtained by subtracting the number of bits Doff(n−1) presenting the count of zero based on the R, G and B digital data (R, G, and B Data(n−1)), inputted to the $(n-1)^{th}$ line of the LCD panel 260, from the number of bits Doff(n) presenting the count of zero based on the R, G and B digital data (R, G, and B Data(n)) inputted to the $n^{th}$ line of the LCD panel 260.

That is, as shown in Equations 1 and 2 below, the compensation data Δdiff of the operator 233 are classified into the first compensation data $\Delta diff_1$ and the second compensation data $\Delta diff_2$ and are then operated on.

$$\Delta diff_1 = Don(n) - Don(n-1) \quad \text{Equation 1}$$

$$\Delta diff_2 = Don(n) - Don(n-1) \quad \text{Equation 2}$$

Thus, the operator 233 selects only one equation between Equation 1 for obtaining the first compensation data $\Delta diff_1$ and Equation 2 for obtaining the first compensation data $\Delta diff_2$.

That is, only one of the first compensation data $\Delta diff_1$ obtained by Equation 1 and the second compensation data $\Delta diff_2$ obtained by Equation 2 is selected by the operator 233, and then outputted to the level regulator 234.

Subsequently, the level regulator 234 receives the first compensation data $\Delta diff_1$ or the second compensation data $\Delta diff_2$ from the operator 233, and adjusts or regulates the first compensation data $\Delta diff_1$ or the second compensation data $\Delta diff_2$ so as to constantly maintain them.

That is, the level regulator 234 receives the first compensation data $\Delta diff_1$ or the second compensation data $\Delta diff_2$ from the operator 233, and forms a correction coefficient so as to constantly maintain the first compensation data $\Delta diff_1$ or the second compensation data $\Delta diff_2$ through a predetermined algorithm. In addition, the first compensation data $\Delta diff_1$ or the second compensation data $\Delta diff_2$ are values which are continuously changed, and this is why the correction coefficient acts to prevent a rapid change from occurring in the first compensation data $\Delta diff_1$ or the second compensation data $\Delta diff_2$, and to prevent oscillation from occurring.

In addition, the correction coefficient $\alpha$ is flexibly changed in response to the first compensation data $\Delta diff_1$ or the second compensation data $\Delta diff_2$.

In this case, the correction coefficient $\alpha$ applies to the first compensation data $\Delta diff_1$ or the second compensation data $\Delta diff_2$, so that a first compensation coefficient $\alpha_1$ for correcting the first compensation data $\Delta diff_1$ and a second compensation coefficient $\alpha_2$ for correcting the second compensation data $\Delta diff_2$ are obtained through a predetermined algorithm.

Accordingly, the level regulator 234 generates a first correction data $\alpha_1 \Delta diff_1$ which is outputted in a multiplication form between the first correction coefficient $\alpha_1$ and the first compensation data $\Delta diff_1$ so as to regulate and compensate each other, and generates a second correction data $\alpha_2 \Delta diff_2$ which is outputted in a multiplication form between the second correction coefficient $\alpha_2$ and the second compensation data $\Delta diff_2$ so as regulate and compensate each other. Only one of the first compensation data $\Delta diff_1$ and the second compensation data $\Delta diff_2$ is selected by the level regulator 234, and then delivered to the mixer 235.

Subsequently, as shown in Equations 3 and 4 below, the mixer 235 receives first corrected R, G and B digital data $DATA_1(n)$ or second corrected R, G and B digital data $DATA_2(n)$ which are obtained by subtracting one of the first correction data $\alpha_1 \Delta diff_1$ and the second correction data $\alpha_2 \Delta diff_2$ from R, G and B Data(n) inputted to the ON/OFF counter 231.

$$DATA_1(n) = R,G,Bdata(n) - \alpha_1 \Delta diff_1 \quad \text{Equation 3}$$

$$DATA_2(n) = R,G,Bdata(n) - \alpha_2 \Delta diff_2 \quad \text{Equation 4}$$

According to Equation 3, R, G and B Data(n) is inputted to the ON/OFF counter 231, the first compensation data $\Delta diff_1$ is obtained by subtracting the number of bits counting the number of only one of the R, G and B digital data (R, G and B Data(n−1)) from the number of bits counting the number of only one of the R, G and B digital data (R, G and B Data(n)), and the first correction coefficient $\alpha_1$ generated through a predetermined algorithm already implanted into the level regulator is applied.

In addition, according to Equation 4, R, G and B Data(n) is inputted to the ON/OFF counter 231, the second compensation data $\Delta diff_2$ is obtained by subtracting the number of bits counting the number of only zero of the R, G and B digital data (R, G and B Data(n−1)) from the number of bits counting the number of only zero of the R, G and B digital data (R, G and B Data(n)), and the second correction coefficient $\alpha_2$ generated through a predetermined algorithm already implanted into the level regulator 234 is applied.

Accordingly, the first corrected R, G and B digital data $DATA_1(n)$ or the second corrected data R, G and B digital data $DATA_2(n)$ are outputted to the LCD panel 260 through the data driver.

In this case, the second feed-forward path of the feed-forward circuit 230 further includes a delay circuit, which adjusts a transfer time of R, G and B digital data outputted through the second feed-forward path and a transfer time of the first correction data $\alpha_1 \Delta diff_1$ or the second correction data $\alpha_2 \Delta diff_2$ outputted through the respective components of the first feed-forward path, and removes a delay time.

In the LCD according to the present invention, a color blurring phenomenon, which occurs between the $n^{th}$ line and the $(n-1)^{th}$ line of the LCD panel 260 through the feed-forward circuit, can be compensated and corrected, so that image quality and life of the LCD can be enhanced.

In addition, the LCD according to the present invention employs a color field sequential driving type so that separate light sources of three primary colors, such as red, green and blue, are defined so as to be sequentially and periodically displayed with one frame, and the color field sequential LCD allows the three primary colors to be sequentially displayed through the liquid crystal in a time division manner, thereby displaying a color using a persistence effect of vision.

According to the present invention as mentioned above, the LCD has the feed-forward circuit so that the color blurring can be prevented from occurring in each line of the LCD panel 260.

It will be apparent to those skilled in the art that various modifications and variations of the present invention can be made without departing from the spirit or scope of the invention. Thus, it is intended that the present invention cover the modifications and variations of this invention, provided that they fall within the scope of the appended claims and their equivalents.

What is claimed is:

1. A liquid crystal display (LCD), comprising:

a feed-forward circuit for comparing first digital data and second digital data, for generating a correction value based on the comparison, for applying the correction value to the second digital data to obtain corrected digital data, and for outputting the corrected digital data; and a liquid crystal display panel for receiving the corrected digital data, and for displaying an image corresponding to the corrected digital data;

wherein the feed-forward circuit comprises:

a first feed-forward path for comparing a number of bits represented as one among the first digital data and a number of bits represented as one among the second digital data, and for generating the correction value;

a second feed-forward path for providing the second digital data; and a mixer for generating the corrected digital data by using the correction value of the first feed-forward path and the second digital data of the second feed-forward path; and wherein the first feed-forward path comprises:

an ON-counter for counting the number of bits represented as one among the first digital data and the number of bits represented as one among the second digital data;

a memory for storing the number of bits represented as one among the first digital data and the number of bits represented as one among the second digital data;

an operator for receiving the number of bits represented as one among the first digital data and the number of bits represented as one among the second digital data which are stored in the memory, and for generating compensation data by means of operation; and a level regulator for receiving the compensation data, for applying a correction coefficient, and for generating the correction value.

2. The LCD according to claim 1, wherein the LCD sequentially and periodically displays separate light sources of red, green and blue colors in each of a plurality of frames based on a color field sequential driving mode.

3. The LCD according to claim 1, wherein the compensation data are obtained from a subtraction operation performed on the number of bits represented as one among the first digital data and the number of bits represented as one among the second digital data.

4. The LCD according to claim 3, wherein the correction value is obtained by multiplying the compensation data by the correction coefficient.

5. The LCD according to claim 1, wherein the operator transfers a command signal to the memory for receiving the number of bits represented as one among the first digital data and the number of bits represented as one among the second digital data which are stored in the memory.

6. The LCD according to claim 1, wherein the level regulator generates the correction coefficient for regulating the compensation data through an algorithm which is implanted therein.

7. The LCD according to claim 6, wherein the correction coefficient is a value which flexibly varies.

8. The LCD according to claim 1, wherein the mixer subtracts the correction value from the second digital data to generate the corrected digital data.

9. The LCD according to claim 1, wherein the second feed-forward path comprises a delay circuit for generating a delay corresponding to a delay time taken for receiving the corrected digital data from the mixer and providing the corrected digital data to the liquid crystal display panel.

10. A liquid crystal display (LCD), comprising:

a feed-forward circuit for comparing first digital data and second digital data, for generating a correction value based on the comparison, for applying the correction value to the second digital data to obtain corrected digital data, and for outputting the corrected digital data; and a liquid crystal display panel for receiving the corrected digital data, and for displaying an image corresponding to the corrected digital data;

wherein the feed-forward circuit comprises:

a first feed-forward path for comparing a number of bits represented as zero among the first digital data and a number of bits represented as zero among the second digital data, and for generating the correction value;

a second feed-forward path for providing the second digital data; and a mixer for generating the corrected digital data by using the correction value of the first feed-forward path and the second digital data of the second feed-forward path; and wherein the first feed-forward path comprises:

an OFF-counter for counting the number of bits represented as zero among the first digital data and the number of bits represented as zero among the second digital data;

a memory for storing the number of bits represented as zero among the first digital data and the number of bits represented as zero among the second digital data;

an operator for receiving the number of bits represented as zero among the first digital data and the number of bits represented as zero among the second digital data, and for generating compensation data by means of operation; and a level regulator for receiving the compensation data from the operator, for applying a correction coefficient, and for generating a correction value.

11. A liquid crystal display (LCD), comprising:

an ON-counter for receiving first digital data and second digital data, and for counting a number of bits represented as one among the first digital data and a number of bits represented as one among the second digital data;

a memory for storing the number of bits represented as one among the first digital data and the number of bits represented as one among the second digital data;

an operator for receiving the number of bits represented as one among the first digital data and the number of bits represented as one among the second digital data, and for generating compensation data by means of operation;

a level regulator for receiving the compensation data, for operating on the compensation data with a correction coefficient, and for generating a correction value;

a mixer for operating on the second digital data and the correction value, and for generating corrected digital data; and a liquid crystal display panel for receiving the corrected digital data, and for displaying an image corresponding to the corrected digital data.

12. The LCD according to claim 11, wherein the LCD sequentially and periodically displays separate light sources of red, green and blue colors in each of a plurality of frames based on a color field sequential driving mode.

13. The LCD according to claim 12, wherein the compensation data are obtained from a subtraction operation performed on the number of bits represented as one among the first digital data and the number of bits represented as one among the second digital data.

14. The LCD according to claim 13, wherein the correction value is obtained by multiplying the compensation data by the correction coefficient.

15. A liquid crystal display (LCD), comprising:

an OFF-counter for receiving first digital data and second digital data, and for counting a number of bits represented as zero among the first digital data and a number of bits represented as zero among the second digital data;

a memory for storing the number of bits represented as zero among the first digital data and the number of bits represented as zero among the second digital data;

an operator for operating on the number of bits represented as zero among the first digital data and the number of bits represented as zero among the second digital data, and for generating compensation data;

a level regulator for receiving the compensation data, for operating on the compensation data with a correction coefficient, and for generating a correction value;

a mixer for operating on the second digital data and the correction value, and for generating corrected digital data; and a liquid crystal display panel for receiving the corrected digital data, and for displaying an image corresponding to the corrected digital data.

16. The LCD according to claim 15, wherein the LCD sequentially and periodically displays separate light sources of red, green and blue colors in each of a plurality of frames based on a color field sequential driving mode.

17. The LCD according to claim 16, wherein the compensation data are obtained from a subtraction operation performed on the number of bits represented as zero among the first digital data and the number of bits represented as zero among the second digital data.

18. The LCD according to claim 17, wherein the correction value is obtained by multiplying the compensation data by the correction coefficient.

* * * * *